US009581161B2

(12) United States Patent
Bingham et al.

(10) Patent No.: US 9,581,161 B2
(45) Date of Patent: Feb. 28, 2017

(54) COMPRESSOR WITH SERVICE VALVE ASSEMBLY

(71) Applicant: Emerson Climate Technologies, Inc., Sidney, OH (US)

(72) Inventors: Larry L. Bingham, Greenville, OH (US); Keith J. Reinhart, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 387 days.

(21) Appl. No.: 14/068,857

(22) Filed: Oct. 31, 2013

(65) Prior Publication Data

US 2014/0140876 A1 May 22, 2014

Related U.S. Application Data

(60) Provisional application No. 61/729,034, filed on Nov. 21, 2012.

(51) Int. Cl.

| | |
|---|---|
| ***F04C 28/26*** | (2006.01) |
| ***F04C 18/02*** | (2006.01) |
| *F04C 23/00* | (2006.01) |

(52) U.S. Cl.

CPC ..... *F04C 28/26* (2013.01); *F04C 18/0215* (2013.01); *F04C 23/008* (2013.01); *Y10T 29/4924* (2015.01); *Y10T 137/877* (2015.04)

(58) Field of Classification Search

CPC ..... F04C 18/0215; F04C 23/008; F04C 28/26
USPC ..... 417/310
See application file for complete search history.

(56) References Cited

U.S. PATENT DOCUMENTS 5,591,014 A * 1/1997 Wallis ..... F04C 18/0215 417/310
6,821,092 B1 * 11/2004 Gehret ..... F04C 28/265 417/213

* cited by examiner

*Primary Examiner* — Charles Freay
*Assistant Examiner* — Philip Stimpert
(74) *Attorney, Agent, or Firm* — Harness, Dickey & Pierce, P.L.C.

(57) ABSTRACT

A scroll machine can include a shell, a first scroll member, a second scroll member and a valve assembly. The valve assembly can permit intermediate pressure in the shell to flow to an area of suction pressure in the shell. The valve assembly can include a first valve manifold that selectively couples to the shell. A second valve manifold can slidably and non-threadably locate against the first valve manifold. A retainer can couple to the first valve manifold to capture the second valve manifold against the first valve manifold. A valve can selectively connect an intermediate flow exiting the shell through the first and second valve manifolds to a suction flow entering the shell.

19 Claims, 4 Drawing Sheets

COMPRESSOR WITH SERVICE VALVE ASSEMBLY

CROSS-REFERENCE TO RELATED APPLICATIONS

This application claims the benefit of U.S. Provisional Application No. 61/729,034, filed on Nov. 21, 2012.

FIELD

The present disclosure relates generally to scroll compressors and more particularly to a valve assembly that is selectively coupled to a scroll compressor to permit intermediate pressure in a housing of the scroll compressor to flow to an area of suction pressure.

BACKGROUND

This section provides background information related to the present disclosure which is not necessarily prior art.

Capacity modulation is often a desirable feature to incorporate into the compressors of refrigeration, heat pump, HVAC, or chiller system (generically, "climate control systems") systems in order to better accommodate the wide range of loading to which the systems may be subjected. Many different approaches have been utilized for providing this capacity modulation feature. These approaches have ranged from control of the suction inlet of the compressor to bypassing compressed discharge gas back into the suction pressure zone of the compressor. With a scroll-type compressor, capacity modulation has often been accomplished by using a delayed suction approach which comprises providing ports at various positions along the scroll wrap which, when opened, allow the initially formed compression chambers between the intermeshing scroll wraps to communicate with the suction zone of the compressor, thereby delaying the point at which the sealed compression chambers are formed and, thus, delaying the start of compression of the suction gas. Such a method of capacity modulation can have the effect of reducing the compression ratio of the compressor. While these delayed suction systems are effective at reducing the capacity of the compressor, they are only able to provide a predetermined amount of compressor unloading with the amount being determined by the position of the unloading ports along the scroll wraps.

SUMMARY

This section provides a general summary of the disclosure, and is not a comprehensive disclosure of its full scope or all of its features.

A scroll machine according to the present disclosure can include a shell, a first scroll member, a second scroll member and a valve assembly. The valve assembly can permit intermediate pressure in the shell to flow to an area of suction pressure in the shell. The valve assembly can include a first valve manifold that selectively couples to the shell. A second valve manifold can slidably and non-threadably locate against the first valve manifold. A retainer can couple to the first valve manifold to capture the second valve manifold against the first valve manifold. A valve can selectively connect an intermediate flow exiting the shell through the first and second valve manifolds to a suction flow entering the shell.

According to additional features, the valve can include a first and a second valve. The first and second valves can be solenoid actuated. The first valve manifold can be threadably coupled to a cylinder mount on the shell. The retainer can be threadably coupled to the first valve manifold.

According to still other features, one of the first and second valve manifolds can define a first annular groove that fluidly connects a first intermediate flow passage in the first valve manifold with a second intermediate flow passage in the second valve manifold. The first annular groove can permit the first and second intermediate flow passages to connect regardless of a rotational orientation of the second valve manifold relative to the first valve manifold. One of the first and second valve manifolds can define a second annular groove that fluidly connects a first suction flow passage in the first valve manifold with a second suction flow passage in the second valve manifold. The second annular groove can permit the first and second suction flow passages to connect regardless of a rotational orientation of the second valve manifold relative to the first valve manifold.

According to other features, one of the first and second valve manifolds can define a radial groove having an O-ring disposed therein. One of the first and second valve manifolds can further define three radial grooves, each having an O-ring disposed therein. One of the first valve manifold and the cylinder mount can define a groove defined in an end face. The groove can have an O-ring therein. One of the first and second valve manifolds can include a first end face that opposes the other of the first and second valve manifolds. The first end face can define a first groove having a first O-ring disposed therein. One of the second valve manifold and the retainer can include a second end face that opposes the other of the second valve manifold and retainer. The second end face defines a second groove having a second O-ring disposed therein.

A method of coupling a valve assembly to a shell of a scroll compressor can include threadably coupling a first valve manifold to a cylinder mount on the shell. A second valve manifold can be slidably and non-threadably advanced onto the first valve manifold. A retainer can be threadably coupled to the first valve manifold whereby the second valve manifold is captured between the first valve manifold and the retainer in an installed position. In the installed position, a valve can connect an intermediate flow exiting the shell through the first and second valve manifolds to a suction flow entering the shell.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. The following description of the preferred embodiment(s) is merely exemplary in nature and is in no way intended to limit the disclosure, its application, or uses.

Figure 1:
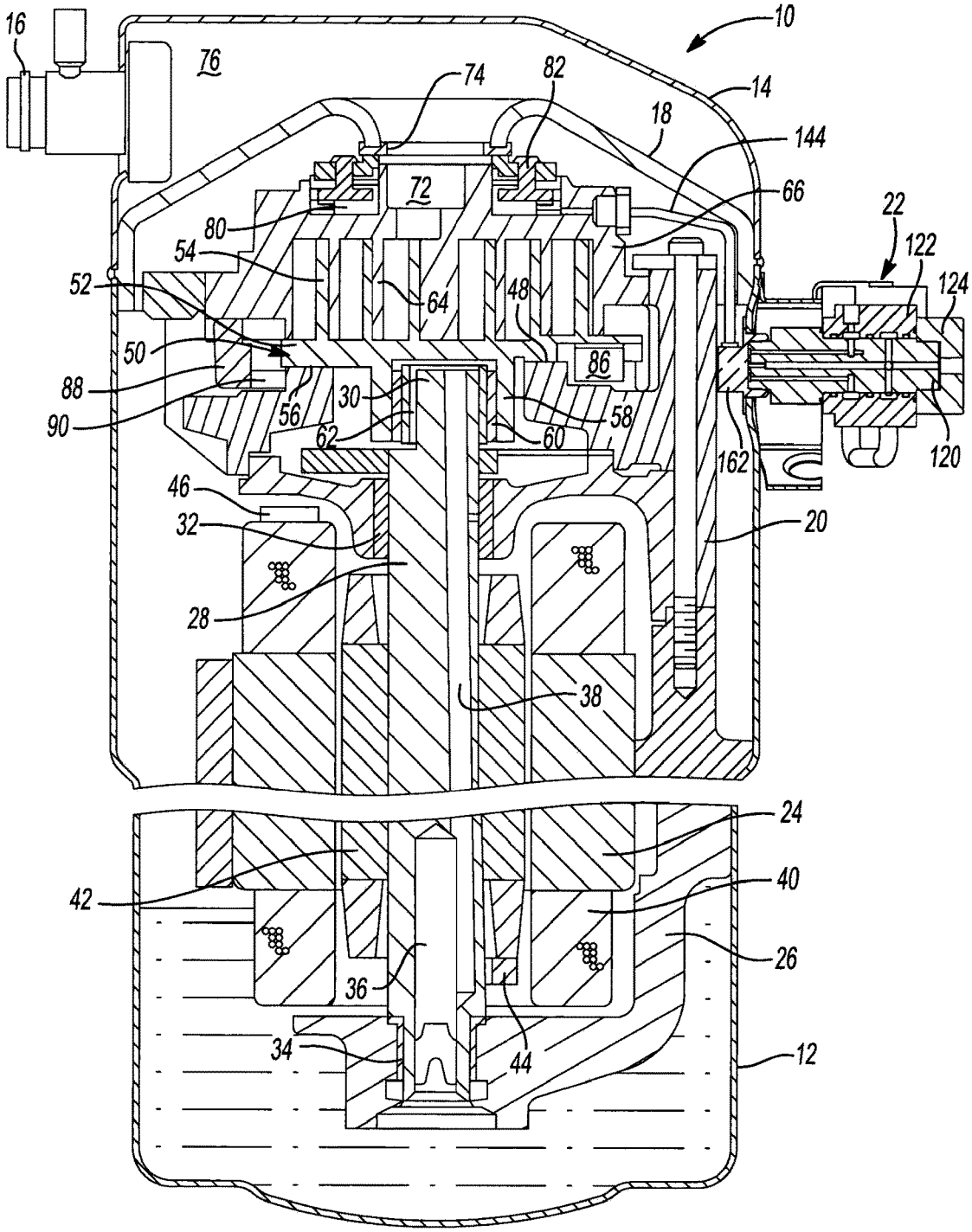
FIG. 1 is a vertical section view of a scroll-type compressor incorporating a capacity modulation system and valve assembly according to the present disclosure.

While the present disclosure is suitable for incorporation in many different types of scroll machines, including hermetic machines, open drive machines and non-hermetic machines, for exemplary purposes it will be described herein incorporated in a hermetic scroll refrigerant motor-compressor 10 of the "low side" type (i.e., where the motor and compressor are cooled by suction gas in the hermetical shell, as illustrated in the vertical section shown in FIG. 1). Generally speaking, compressor 10 comprises a cylindrical hermetic housing or shell 12 which includes at the upper end thereof an end cap 14. End cap 14 is provided with a refrigerant discharge fitting 16 optionally having the usual discharge valve therein. Other elements affixed to the shell 12 include a transversely extending partition 18 which is welded about its periphery at the same point that end cap 14 is welded to shell 12, a two-piece main bearing housing 20 which is affixed to shell 12 at a plurality of points in any desirable manner, and a valve assembly 22 disposed in communication with the suction pressure zone of compressor 10 inside shell 12. As will be described in greater detail herein, the valve assembly 22 can control flow between an intermediate pressure and a suction pressure.

A motor stator 24 is press fit into a frame 26 which is in turn press fit into shell 12. A crankshaft 28 having an eccentric crank pin 30 at the upper end thereof is rotatably journaled in a bearing 32 in main bearing housing 20 and a second bearing 34 in frame 26. Crankshaft 28 has at the lower end the usual relatively large diameter oil-pumping concentric bore 36 which communicates with a radially outwardly inclined smaller diameter bore 38 extending upwardly therefrom to the top of crankshaft 28. The lower portion of the interior shell 12 is filled with lubricating oil in the usual manner and concentric bore 36 at the bottom of crankshaft 28 is the primary pump acting in conjunction with bore 38, which acts as a secondary pump, to pump lubricating fluid to all the various portions of compressor 10 which require lubrication.

Crankshaft 28 is rotatively driven by an electric motor including stator 24 having windings 40 passing therethrough, and a rotor 42 press fit on crankshaft 28 and having one or more counterweights 44. A motor protector 46, of the usual type, is provided in close proximity to motor windings 40 so that if the motor exceeds its normal temperature range motor protector 46 will de-energize the motor.

The upper surface of main bearing housing 20 is provided with an annular flat thrust bearing surface 48 on which is disposed an orbiting scroll member 50 comprising an end plate 52 having the usual spiral vane or wrap 54 on the upper surface thereof, an annular flat thrust surface 56 on the lower surface, and projecting downwardly therefrom a cylindrical hub 58 having a journal bearing 60 therein and in which is rotatively disposed a drive bushing 62 having an inner bore in which crank pin 30 is drivingly disposed. Crank pin 30 has a flat on one surface (not shown) which drivingly engages a flat surface in a portion of the inner bore of drive bushing 62 to provide a radially compliant driving arrangement, such as shown in assignee's U.S. Pat. No. 4,877,382, the disclosure of which is herein incorporated by reference.

Wrap 54 meshes with a non-orbiting spiral wrap 64 forming a part of non-orbiting scroll member 66 which is mounted to main bearing housing 20 in any desired manner which will provide limited axial movement of scroll member 66. The specific manner of such mounting is not relevant to the present inventions. For a more detailed description of the non-orbiting scroll suspension system, see assignee's U.S. Pat. No. 5,055,010, the disclosure of which is hereby incorporated herein by reference.

Non-orbiting scroll member 66 has a centrally disposed discharge passageway communicating with an upwardly open recess 72 which is in fluid communication via an opening 74 in partition 18 with a discharge muffler chamber 76 defined by end cap 14 and partition 18. A pressure relief valve (not shown) is disposed between the discharge muffler chamber 76 and the interior of shell 12. The pressure relief valve will open at a specified differential pressure between the discharge and suction pressures to vent pressurized gas from the discharge muffler chamber 76. Non-orbiting scroll member 66 has in the upper surface thereof, a biasing chamber or an annular recess 80 having parallel coaxial side walls in which is sealingly disposed for relative axial movement an annular floating seal 82 which serves to isolate the bottom of recess 80 from the presence of gas under suction and discharge pressure so that it can be placed in fluid communication with a source of intermediate fluid pressure by means of a passageway (not shown). Non-orbiting scroll member 66 is thus axially biased against orbiting scroll member 50 by the forces created by discharge pressure acting on the central portion of scroll member 66 and those created by intermediate fluid pressure acting on the bottom of recess 80. This axial pressure biasing, as well as various techniques for supporting scroll member 66 for limited axial movement, are disclosed in much greater detail in assignee's aforesaid U.S. Pat. No. 4,877,328.

Relative rotation of the scroll members is prevented by the usual Oldham coupling comprising a ring 86 having a first pair of keys 88 (one of which is shown) slidably disposed in diametrically opposed slots 90 (one of which is shown) in scroll member 66 and a second pair of keys (not shown) slidably disposed in diametrically opposed slots in scroll member 50. Additional description of the operation of the compressor 10 may be found in assignee's U.S. Pat. No. 6,821,092, the disclosure of which is incorporated herein by reference.

Figure 2:
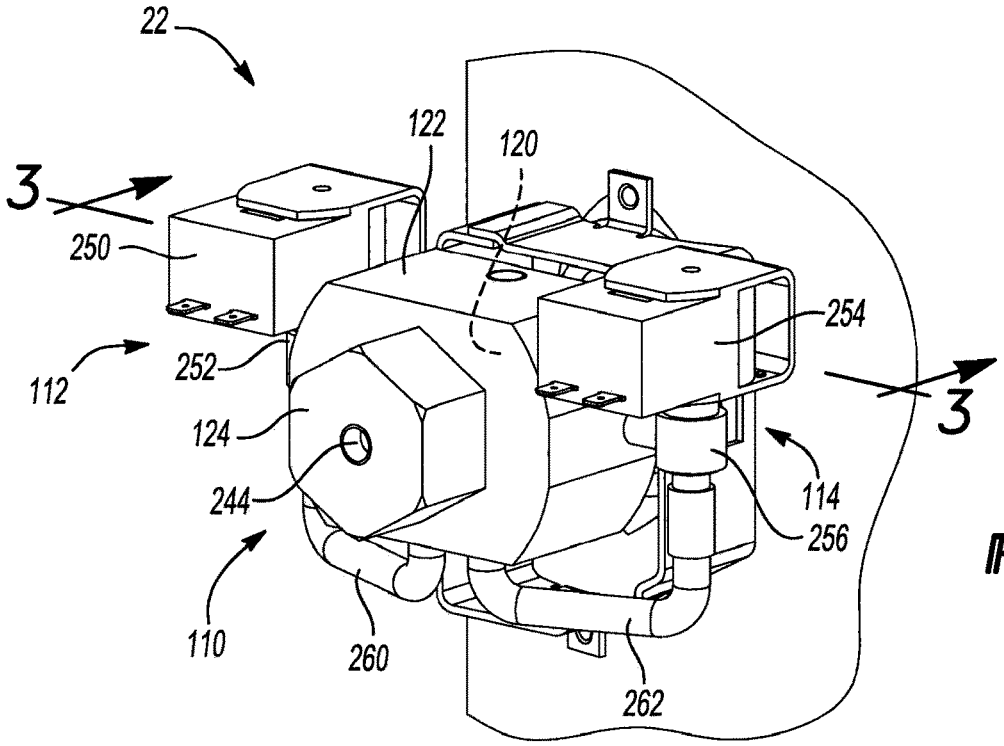
FIG. 2 is a side perspective view of the valve assembly of FIG. 1.
Figure 3:
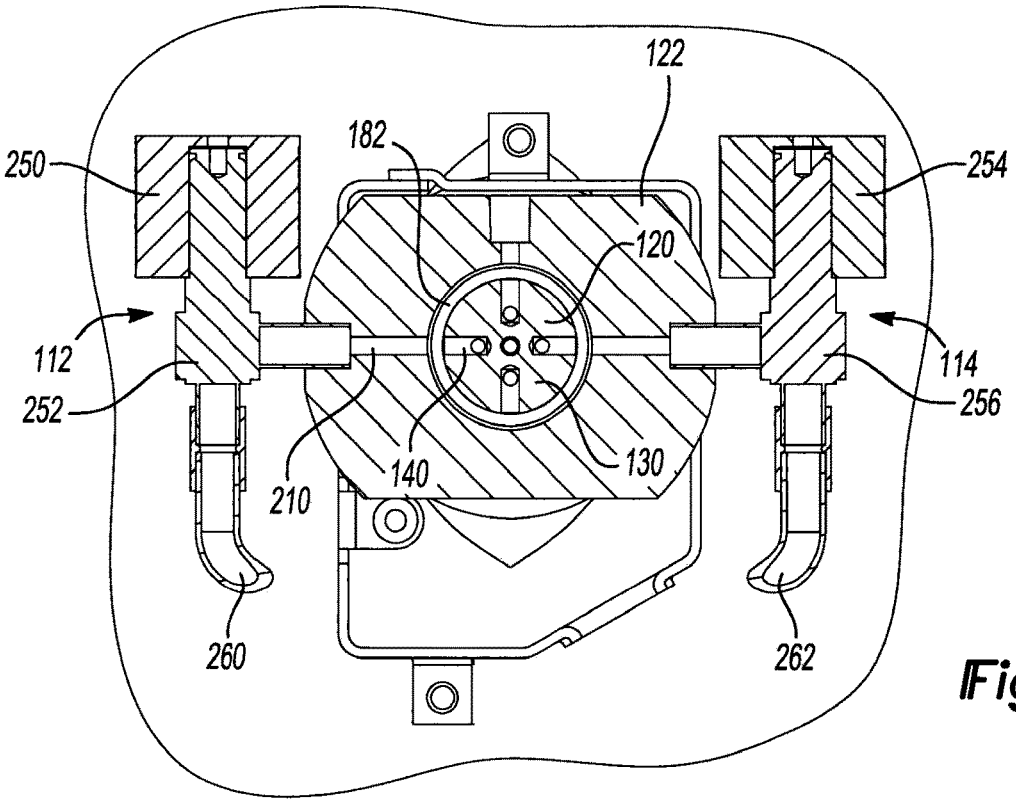
FIG. 3 is a cross-sectional view taken along lines 3-3 of FIG. 2.
Figure 4:
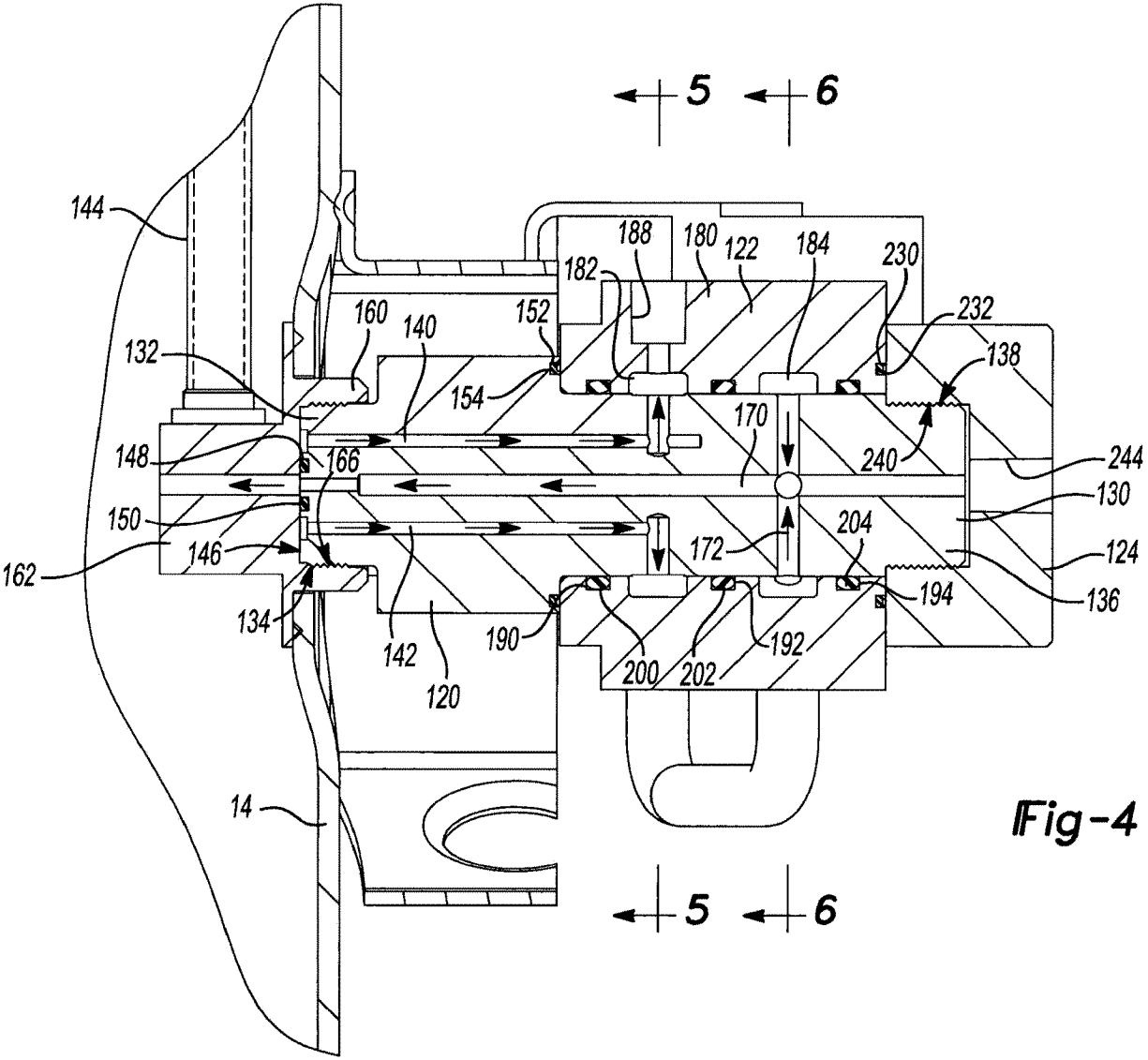
FIG. 4 is a detailed cross-sectional view of the valve assembly as shown in FIG. 1.

With additional reference now to FIGS. 2-4, the valve assembly 22 will be described in greater detail. The valve assembly 22 is mounted to the non-orbiting scroll member 66, and may include a valve manifold assembly 110, a first solenoid valve assembly 112 and a second solenoid valve assembly 114. As will become appreciated from the following discussion, the first and second solenoid valve assemblies 112 and 114 can cooperate to control flow through the valve manifold assembly 110 between an intermediate pressure in the non-orbiting scroll member 66 and a suction pressure in the shell 12.

The valve manifold assembly 110 can include a first valve manifold 120, a second valve manifold 122 and a retainer nut 124. The first valve manifold 120 can comprise a first valve manifold body 130. The first valve manifold body 130 can have a first end 132 that defines threads 134 and a second end 136 that defines threads 138. The first valve manifold body 130 can further include a first intermediate flow passage 140. While the flow passage 140 is represented in the drawings as multiple distinct channels, other configurations are contemplated including a single passage or additional passages. The first intermediate flow passage 140 can direct intermediate flow indicated by arrows 142 from an area of intermediate pressure within the non-orbiting scroll member 66, through a passageway 144, and into the second valve manifold 122. The first end 132 can further define an end face 146 having an annular groove 148 containing a first seal 150, such as an O-ring or a gasket. An intermediate groove 152 can also be defined into the first valve manifold body 130 and can contain second seal 154, such as an O-ring or a gasket. The first end 132 of the first valve manifold 120 can be received at a port 160 provided on a cylinder mount 162 fixed to the shell 12 by welding or other suitable fastening techniques. Specifically, the threads 134 on the first end 132 of the first valve manifold body 130 can be threadingly received by complementary threads 166 defined on the port 160 of the cylinder mount 162. The first seal 150 can engage the cylinder mount 162 to further provide a fluid-tight connection.

The first valve manifold body 130 can further define a first suction flow passage 170 that can direct suction flow indicated by arrows 172 from the second valve manifold 122 and back to the shell 12 through the cylinder mount 162. Again, it will be appreciated that the flow passage 170 may be configured differently. For example, additional passages may be configured through the first valve manifold body 130.

The second valve manifold 122 will now be described in greater detail. The second valve manifold 122 can generally communicate intermediate flow 142 and suction flow 172 between the first valve manifold 120 and the respective first and second solenoid valve assemblies 112 and 114. The second valve manifold 122 can include a second valve manifold body 180 that can generally define a first annular groove 182 that can communicate with the intermediate flow 142 and a second annular groove 184 that can communicate with the suction flow 172.

Figure 6:
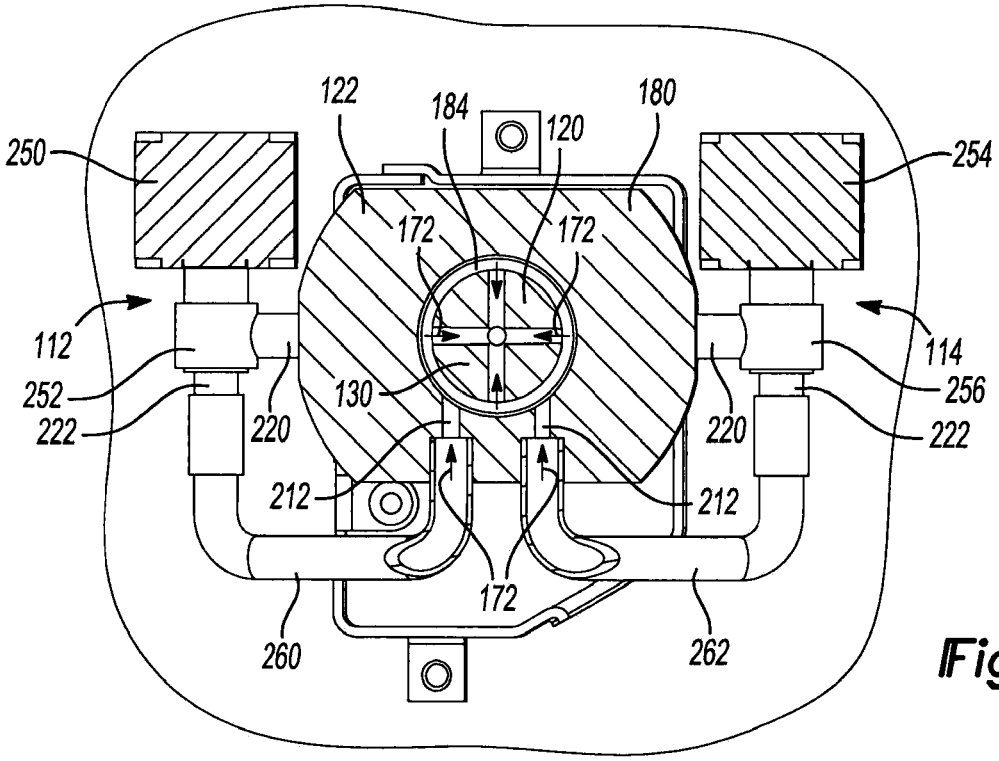
FIG. 6 is a cross-sectional view taken along lines 6-6 of FIG. 4.

The second valve manifold 122 can further include an optional pressure tapping aperture 188. The second valve manifold body 180 can further include radial grooves 190, 192 and 194 that can receive third, fourth, and fifth seals 200, 202 and 204, respectively. The second valve manifold body 180 can define second intermediate flow passages 210 (FIG. 3) and second suction flow passages 212 (FIG. 6). The second intermediate flow passages 210 can fluidly communicate with an intermediate flow valve inlet 220. The second suction flow passages 212 can fluidly communicate with a suction outlet 222 of the first and second solenoid valve assemblies 112 and 114. The second valve manifold body 180 can additionally define an annular groove 230 (FIG. 4) having an O-ring 232 disposed therein.

As will be further described herein, the second valve manifold 122 can be slidably installed around the first valve manifold body 130. Explained in greater detail, the second valve manifold 122 can be slidably advanced along the first valve manifold body 130 without threads. Furthermore, the orientation of the first and second annular grooves 182 and 184 are such that the second valve manifold 122 need not attain a pre-desired rotational orientation relative to the first valve manifold 120. In this regard, the configuration of the valve assembly 22 disclosed herein can provide an installer with a simplified and robust configuration.

The retainer nut 124 can generally include threads 240 that can threadably mate with the threads 138 on the first valve manifold body 130. Advancing of the retainer nut 124 can capture the second valve manifold body 180 relative to the first valve manifold body 130. The retainer nut 124 can optionally define a pressure tapping aperture 244.

The first solenoid valve assembly 112 can include a first solenoid 250 and a first valve 252. The second solenoid valve assembly can include a second solenoid 254 and a second valve 256. A first pipe 260 (FIG. 3) can fluidly communicate suction pressure from the first valve 252 and into the second valve manifold 122. Similarly, a second pipe 262 (FIG. 3) can fluidly communicate a suction pressure from the second valve 256 back to the second valve manifold 122.

Figure 5:
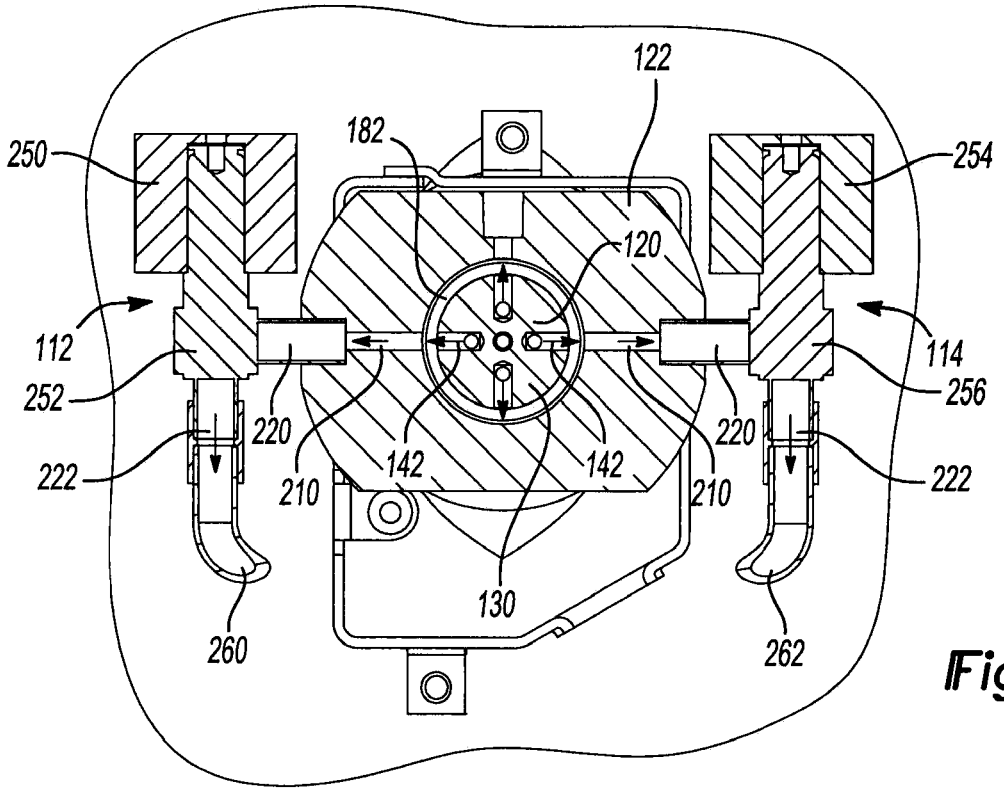
FIG. 5 is a cross-sectional view taken along lines 5-5 of FIG. 4.

Operation of the valve assembly according to one example will be described. In general, the solenoids 250 actuate the valves 252 between an open and a closed position. In an open position, flow may be communicated between the intermediate flow valve inlet 220 and the suction outlet 222 (FIG. 5). In a closed position, flow can be precluded between the intermediate flow valve inlet 220 and the suction outlet 222. It will be appreciated that the valves 252 may also operate in a position between fully open and fully closed.

A method of assembling the valve assembly 22 relative to the shell 12 will now be described. It will be appreciated that in some examples the first and second solenoid valve assemblies may be already coupled to the second valve manifold body 180 by way of first and second pipes 260, 262. In other examples, these components may be assembled on-site. At the outset, the first valve manifold 120 is threadably coupled relative to the port 160 on the cylinder mount 162. Next, the second valve manifold 122 is slidably advanced onto the first valve manifold body 130 (in a direction leftward as viewed in FIG. 4) toward the second seal 154. Again, because the first annular groove 182 can couple the first intermediate flow passage 140 (FIG. 4) on the first valve manifold 120 with the second intermediate flow passage 210 (FIG. 5) regardless of a rotational orientation of the second valve manifold 122, the installation may be simplified. Similarly, the second annular groove 184 can couple the first suction flow passage 170 (FIG. 4) with the second suction flow passage 212 (FIG. 6) regardless of rotational orientation of the second valve manifold 122. Next, the retainer nut 124 can be threadably advanced (in a direction leftward as viewed in FIG. 4) onto the threads 138 on the first valve manifold 120. In an installed position (FIG. 4), the retainer nut 124 influences axial compression of the first and second valve manifolds 120, 122 at the second seal 154 as well as axial compression of the retainer nut 124 and second valve manifold 122 at the sixth seal 232.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A scroll machine comprising:

a shell;

a first scroll member disposed in the shell and having a first spiral wrap;

a second scroll member disposed in the shell and having a second spiral wrap, the second spiral wrap being intermeshed with the first spiral wrap;

a valve assembly that permits intermediate pressure in the shell to flow to an area of suction pressure in the shell, the valve assembly comprising:

a first valve manifold that selectively couples to the shell;

a second valve manifold that is slidably and non-threadably positioned surrounding the first valve manifold;

a retainer that is directly coupled to the first valve manifold to capture the second valve manifold against the first valve manifold; and a valve that selectively connects an intermediate flow exiting the shell through the first and second valve manifolds and to a suction flow entering the shell.

2. The scroll machine of claim 1 wherein the valve comprises a first valve and a second valve.

3. The scroll machine of claim 2 wherein the first valve and the second valve are solenoid actuated.

4. The scroll machine of claim 1 wherein the first valve manifold is threadably coupled to a cylinder mount on the shell.

5. The scroll machine of claim 1 wherein the retainer is threadably coupled to the first valve manifold.

6. The scroll machine of claim 1 wherein one of the first and second valve manifolds defines a first annular groove that fluidly connects a first intermediate flow passage in the first valve manifold with a second intermediate flow passage in the second valve manifold.

7. The scroll machine of claim 6 wherein the first annular groove permits the first and second intermediate flow passages to connect regardless of a rotational orientation of the second valve manifold relative to the first valve manifold.

8. The scroll machine of claim 1 wherein one of the first and second valve manifolds defines a second annular groove that fluidly connects a first suction flow passage in the first valve manifold with a second suction flow passage in the second valve manifold.

9. The scroll machine of claim 8 wherein the second annular groove permits the first and second suction flow passages to connect regardless of a rotational orientation of the second valve manifold relative to the first valve manifold.

10. The scroll machine of claim 1 wherein one of the first and second valve manifolds defines a radial groove having a seal disposed therein.

11. The scroll machine of claim 10 wherein one of the first and second valve manifolds defines three radial grooves, each having a seal disposed therein.

12. The scroll machine of claim 4 wherein one of the first valve manifold and the cylinder mount defines a groove in an end face, the groove having a seal disposed therein.

13. The scroll machine of claim 1 wherein one of the first and second valve manifolds includes a first end face that opposes the other of the first and second valve manifolds, the first end face defining a first groove having a first seal disposed therein.

14. The scroll machine of claim 13 wherein one of the second valve manifold and the retainer includes a second end face that opposes the other of the second valve manifold and retainer, the second end face defining a second groove having a second seal disposed therein.

15. A valve assembly that couples to a shell of a scroll machine, the valve assembly comprising:

a first valve manifold that selectively couples to the shell;

a second valve manifold that is slidably and non-threadably disposed surrounding the first valve manifold;

a retainer that is directly coupled to the first manifold to capture the second manifold against the first manifold; and a valve that selectively connects an intermediate flow exiting the shell through the first and second manifolds and to a suction flow entering the shell.

16. The valve assembly of claim 15 wherein the first valve manifold is threadably coupled to a cylinder mount on the shell.

17. The valve assembly of claim 16 wherein the retainer is threadably coupled to the first valve manifold.

18. The valve assembly of claim 15 wherein one of the first and second valve manifolds defines a first annular groove that fluidly connects a first intermediate flow passage in the first valve manifold with a second intermediate flow passage in the second valve manifold and wherein the first annular groove permits the first and second intermediate flow passages to connect regardless of a rotational orientation of the second valve manifold relative to the first valve manifold.

19. The valve assembly of claim 15 wherein one of the first and second valve manifolds defines a second annular groove that fluidly connects a first suction flow passage in the first valve manifold with a second suction flow passage in the second valve manifold and wherein the second annular groove permits the first and second suction flow passages to connect regardless of a rotational orientation of the second valve manifold relative to the first valve manifold.

* * * * *